US007178242B2

(12) United States Patent
Okabe

(10) Patent No.: US 7,178,242 B2
(45) Date of Patent: Feb. 20, 2007

(54) ELECTRIC ROTARY SHAVER

(75) Inventor: Masaki Okabe, Matsumoto (JP)

(73) Assignee: Izumi Products Company, Nagano (JP)

( * ) Notice: Subject to any disclaimer, the term of this patent is extended or adjusted under 35 U.S.C. 154(b) by 47 days.

(21) Appl. No.: 11/002,807

(22) Filed: Dec. 1, 2004

(65) Prior Publication Data

US 2005/0120567 A1 Jun. 9, 2005

(30) Foreign Application Priority Data

Dec. 3, 2003 (JP) ..... 2003-404061
Nov. 29, 2004 (JP) ..... 2004-336201

(51) Int. Cl.
*B26B 19/02* (2006.01)

(52) U.S. Cl. ..... 30/43.6; 30/346.51

(58) Field of Classification Search ..... 30/43.6, 30/346.51, 43.5

See application file for complete search history.

(56) References Cited

U.S. PATENT DOCUMENTS 4,343,086 A * 8/1982 de Vries et al. ..... 30/43.6
4,393,586 A * 7/1983 Hamashima et al. ..... 30/43.6
4,707,923 A * 11/1987 Tietjens ..... 30/346.51
6,199,282 B1 * 3/2001 Uchiyama et al. ..... 30/43.6
6,581,289 B2 * 6/2003 Nakano ..... 30/43.6
6,952,879 B2 * 10/2005 Okabe ..... 30/346.51
2002/0083591 A1 7/2002 Geertsma et al.

FOREIGN PATENT DOCUMENTS

EP 1 354 676 10/2003
JP 06-238070 8/1994

* cited by examiner

*Primary Examiner*—Hwei-Siu Payer
(74) *Attorney, Agent, or Firm*—Koda & Androlia

(57) ABSTRACT

An electric rotary shaver including a substantially circular disk form outer cutter, which has hair entry openings, and an inner cutter, which rotates while making sliding contact with the inner surface of the outer cutter; and the inner cutter including an inner cutter base, which is made of a synthetic resin and comprised of a boss that engages with a rotary shaft of the shaver and cutter blade supports that extend radially outward from the boss, and a plurality of cutter blade sections, which have a cutter blade and are installed on the cutter blade supports. The cutter blade sections can be formed in a shape of a ring to make a cutter blade ring so that the cutter blade ring is disposed on the cutter blade supports.

18 Claims, 10 Drawing Sheets

ELECTRIC ROTARY SHAVER

BACKGROUND OF THE INVENTION

1. Field of the Invention

The present invention relates to an electric rotary shaver that includes an inner cutter that rotates while making sliding contact with the inner surface of a substantially circular disk form outer cutter that has a plurality of openings formed on the top surface.

2. Prior Art

In a typical electric rotary shaver, numerous small hair entry openings (e.g., slits) are formed in the top surface of a substantially circular disk form outer cutter that has in its inside a circular track (groove), and an inner cutter is provided so that it rotates while causing its blades (cutter blades) that are integrally disposed on this inner cutter to make sliding contact with the inner surface of this outer cutter. Such an electric rotary shaver is disclosed in, for instance, Japanese Patent Application Laid-Open (Kokai) No. 06-238070.

More specifically, in the conventional inner cutter disclosed in the above prior art, an inner cutter main body made of metal is fastened to a boss that is made of a synthetic resin.

FIG. 10 is a perspective view of the inner cutter disclosed in the above-identified prior art. FIG. 11 is a perspective view of the outer cutter that is used with this inner cutter 10. FIG. 12 is a side view of the inner cutter with a part of the inner cutter omitted. FIG. 13 is a partially sectional side view of this inner cutter. FIG. 14 is a cross sectional side view of an assembled inner cutter and outer cutter of the prior art.

The outer cutter 12 is, as seen from FIG. 11, made of metal and in a substantially circular disk shape. In other words, this outer cutter 12 is made so that a circular plate is bent at the circumferential edge so as to have a shallow substantially dish-form shape or substantially inverted dish-form shape, numerous small hair entry openings constituting slits 14 are formed in this outer cutter 12 in a radial pattern, and an annular groove 16 is further formed in this outer cutter. This groove 16 extends across the slits 14 in the vicinity of the midpoint of each slit 14. As a result, the outer cutter 12 has two annular sections (or annular tracks) 12A and 12B (see FIG. 14) on either side of this groove 16. A structure in an outer cutter that has such two tracks 12A and 12B is called a double track structure.

The boss 18 (see FIG. 10) of the inner cutter 10 is made of a POM (polyoxymethylene) resin, e.g., "Delrin" (Registered Trademark), a product of DuPont, etc.; and the lower portion of the boss 18 has an inverted dish form portion that opens at the bottom. As seen from FIG. 12, an engaging hole 22 with which a rotary shaft (not shown in the drawings) of the shaver is engaged from below is formed in this inverted dish form portion 20. A columnar center projection 24 is disposed in the center of the upper surface of the boss 18.

The inner cutter main body 26 (see FIG. 10) is obtained by stamping and bending a metal plate, and it has a substantially pinwheel-form shape. More specifically, the inner cutter main body 26 has ten mutually separated raised portions 30, which are raised from the outer circumference of a circular plate portion 28, and blade portions 32, which are formed by further bending the raised portions 30 in the radial direction of the boss 18. The center projection 24 of the boss 18 passes through the center of the circular plate portion 28 and is securely fastened by hot-crimping to the upper surface of the inverted dish form portion 20 of the boss 18.

The upper portion of each one of the blade portions 32 of the inner cutter main body 26 is formed into a bifurcated shape, and the ends of the bifurcated blade portions respectively form cutter blades 34. The two cutter blades 34 are respectively set from below (i.e., from the inside) in the two annular sections 12A and 12B of the double-track outer cutter 12. Accordingly, when the inner cutter 10 comprising substantially the boss 18 and inner cutter main body 26 is rotated by the rotary shaft (not shown in the drawings) connected to the motor installed in the shaver main body (not shown in the drawings), the cutter blades 34 run while being in contact with the inner surfaces 12*a* and 12*b* of the annular sections 12A and 12B of the outer cutter 12 (see FIG. 14). As a result, hair (whiskers, etc.) entering through the slits 14 of the outer cutter 12 is cut by the cutter blades 34 of the rotating inner cutter 11.

The upper end portions of the cutter blades 34 of the inner cutter 10 shown here are inclined so that these upper end portions are offset further in the direction of rotation of the inner cutter 10 than the lower portions of the blade portions 32. In other words, the upper end portions are inclined toward the front in terms of the rotating direction of the inner cutter 10.

Furthermore, as shown in FIGS. 12 and 13, recesses 36 are formed in the surfaces of the respective cutter blades 34 so that the recesses 36 face the counter-rotation direction, so that a part of each of the recesses 36 reaches the upper end surface (i.e., the cutting surface that makes sliding contact with the inner surface of the outer cutter 12) of the each cutter blades 34. These recesses 36 prevent shaving debris and dirt from adhering to the cutter blades 34, and it also functions to decrease the area of contact between the cutter blades 34 and the outer cutter 12, reducing the driving resistance (see the above-described cited prior art). In the present invention, however, the recess 36 can be omitted.

The above-described inner cutter 10 and outer cutter 12 make a pair; and, for instance, three pairs of such cutters are provided at the vertices of an equilateral triangle in the cutter head of a shaver. Three inner cutters 10 are rotationally driven by a motor installed in the main body of the shaver. A shaver with two pairs of inner and outer cutters and a shaver with only a single pair of such cutters are also possible.

As seen from the above, in the conventional inner cutter, the entire inner cutter main body 26 is made by press-stamping a single metal plate and then bending this plate approximately 90° at the two places A and B as shown in FIGS. 12 and 13 and 14. When the number of locations where such bending is performed is thus large, the distance from the center of the inner cutter 10 to the cutter blades 34, especially the distance to the inner circumferential edges and outer circumferential edges of the cutter blades 34, tends to become non-uniform, resulting in that the inner and outer circumferential edges of the cutter blades 34 contact the inner and outer circumferential walls 12*c* and 12*d* and the inner and outer circumferential walls 12*e* and 12*f* of the respective annular sections 12A and 12B of the outer cutter 2. This leads to problems such as an aggravation of operating noise and deterioration in sharpness due to an expansion of the annular sections' width of the outer cutter 12. Furthermore, it is necessary, for making inner cutters, to use a special metal material that has good pressing characteristics and that can be hardened.

Furthermore, in rotary shavers, a frictional resistance force generated by the sliding motion between the cutter blades 34 of the inner and the outer cutter 12 and a resistance force that generates when hair is cut are applied to the cutter blades 34. Accordingly, the inner cutter main body 26 must have a sufficient thickness and a high rigidity so that the cutter blades 34 do not vibrate by such resistance forces. Ordinarily, an SUS420J2 metal plate with a thickness of 0.5 mm is used for inner cutters of rotary shavers. In cases where such a thick metal material is pressed (subjected to stamping and bending), the working precision tends to be poor, and problems such as the occurrence of vibration, increase in operating noise, deterioration of sound quality and deterioration of sharpness due to biased wear of the cutter blades tend to occur.

In order to increase the working precision, it is desirable to make the length of the bent portions (A, B) formed by pressing as small as possible. However, if the length of these portions is shortened, the width of the raised portions 30 is naturally reduced, which is disadvantageous from the standpoint of preventing vibration of the cutter blades 34. If the distance between the tip end portions of the cutter blades 34 to which a resistance force is applied and the bent portions (A, B) is large, the stress applied to the bent portions (A, B) increases; and this is disadvantageous from the standpoint of vibration. However, in inner cutters having the conventional structure, there are limitations in shortening this distance.

Thus, because of the structural problems such as poor pressing precision, a large number of bent portions and the like, problems such as vibrations in the cutter blades, resonance of various parts, an increase in operating noise and a deterioration in sound quality have been unavoidable.

SUMMARY OF THE INVENTION

The present invention was made in light of the facts described above.

The object of the present invention is to provide an electric rotary shaver in which, with a new structure of the inner cutter main body, the pressing precision during the making of the inner cutter is high due to the reduced number of places where bending is performed by pressing, the deviation of rotation of the respective cutter blades of the inner cutter from a true circle is prevented, the operating noise is suppressed and the inner cutter's rotating sound quality is high due to the reduced vibration of the cutter blades, and a deterioration in sharpness of the cutter blades caused by biased wear of the cutter blades is prevented.

The above object is accomplished by a unique structure of the present invention for an electric rotary shaver that includes a substantially circular disk form outer cutter, which has hair entry openings in its top surface, and an inner cutter, which rotates while making sliding contact with the inner surface of the outer cutter; and in the present invention, the outer cutter is formed inside thereof with an annular track; and the inner cutter is comprised of:

an inner cutter base which is made of a synthetic resin and is comprised of a boss that engages with a rotary shaft of the shaver and cutter blade supports that extend outward from the boss, the boss and the cutter blade supports being formed integrally, and a plurality of cutter blade sections which are formed with a cutter blade that makes sliding contact with the annular track and which are provided on the cutter blade supports.

In the present invention, the boss and cutter blade supports are formed as an integral unit of the inner cutter base that is made of a synthetic resin and a plurality of cutter blade sections of metal-made are securely held on the cutter blade supports. Accordingly, the need to support the respective cutter blade sections on a circular plate portion or raised portions as in the conventional inner cutter main body is eliminated, and the formation of numerous press-bent portions (A, B) seen in the conventional inner cutter main body becomes unnecessary, and in addition the inner cutter has a high pressing precision by the reduction of the number of bent portions.

Furthermore, the present invention provides several advantages. Not only that the working precision is high but also the vibration of the cutter blades is reduced and a vibration absorbing effect by the synthetic resin made cutter blade supports is assured. Thus, operating noise is reduced, and the sound quality of the rotating inner cutter is high. Furthermore, biased wear of the cutter blades caused by vibration of the cutter blades is suppressed, and deterioration in sharpness is also prevented. Moreover, since the cutter blades tend not to vibrate, it is possible that the cutter blades have a reduced thickness, so that the amount of special expensive metal materials used is reduced.

The cutter blade supports can be formed by a plurality of arms that extend radially from the boss. This structure reduces the weight of the inner cutter; and since shaving debris, etc. made by the cutter blades drops between the radial arms, the shaving debris tends not to adhere to the inner cutter, facilitating the cleaning of the inner cutter and the shaver. The cutter blade supports, however, can be formed as a circular plate as a whole. Furthermore, the number of radial arms can be less than the number of cutter blades; and in this structure, each arm holds more than one (or a plurality of) cutter blade section.

For an electric rotary shaver that has an outer cutter formed inside thereof with a single annular track, the plurality of cutter blade sections can be connected in a ring form to form a cutter blade ring, and this formation of the cutter blade sections facilitates the working (forming) of the cutter blade sections and the attachment of the cutter blade sections to the cutter blade supports. In addition, by way of setting the portion near the cutter blade sections of the cutter blade ring to be held on the upper surfaces of the cutter blade supports, it is possible to prevent the cutter blade sections from vibrating more efficiently. For an electric rotary shaver that has an outer cutter formed inside thereof with a plurality of concentric annular tracks, each of the cutter blade sections has cutter blades that are disposed side by side in the radial direction of the inner cutter, and such cutter blade sections are connected to each other to form a cutter blade ring, and this cutter blade ring is provided on the cutter blade supports. Each of such cutter blade sections can be in a letter Y-shape, the cutter blades are provided in the bifurcated portions of this Y-shaped cutter blade section, and such cutter blade sections are connected to each other at their connecting portions thus forming the cutter blade ring.

The plurality of cutter blade sections can be respectively provided on the respective cutter blade supports. A plurality of cutter blade sections can be combined so as to form a group, so that a plurality of cutter blade groups are provided on the cutter blade supports. The cutter blade supports can be in the shape of a plurality of arms, so that the cutter blade sections in the same number of the cutter blade supports are respectively provided on the respective cutter blade supports. A plurality of cutter blade sections can be combined to form several groups, the cutter blade supports are formed in the same number as the number of groups. The cutter blade sections are provided on the cutter blade support by hot-crimping, or they can be insert-molded on the inner cutter base when the inner cutter base is formed by injection-molding. Furthermore, fastening of the cutter blade sections by means of a bonding material or a combined use of a bonding material is also possible. In addition, inner cutter holding members for holding the cutter blades can be inserted in the inner cutter base, so that the cutter blades are held on the inner cutter holding members.

When the cutter blade sections take the form of the cutter blade ring, the inner circumferential portion of this cutter blade ring can be held on or fastened to the boss. In this structure, since the cutter blade ring is held by the boss and by the cutter blade supports, the cutter blade sections are fastened much more securely, and the vibration of the cutter blades is reduced even further.

The outer cutter that is used with the inner cutter described above can be formed with numerous slits that extend in the radial direction of the outer cutter. An outer cutter in which the slits are obliquely oriented with respect to the radial direction of the outer cutter or an outer cutter in which the slits are curved or bent into a wave shape running more or less in the radial direction can also be used.

For an electric rotary shaver that has an outer cutter formed inside thereof with a single annular track, the inner cutter can be designed so that a part of the central portion of each one of the cutter blade sections of the cutter blade ring that is obtained from, for instance, a metal plate, is cut (by, for instance, press-die-stamping) in the circumferential direction of the cutter blade ring and bent upward to form the cutter blade. In the actual manufacturing process of such a cutter blade ring, the cutter blade ring is formed by press-die-stamping a metal plate into a substantially ring-form shape and by subsequently or simultaneously bending upward the portions that constitute the cutter blades.

For the electric rotary shaver that has an outer cutter formed inside thereof with a single annular track, the inner cutter can also be designed so that a part of the outer circumferential edge of each one of the cutter blade sections of the cutter blade ring is cut in the circumferential direction of the cutter blade ring and bent upward to form the cutter blade in a somewhat cantilever configuration.

In addition, for an electric rotary shaver that has an outer cutter formed inside thereof with two annular tracks, the inner cutter can be designed so that the cutter blade ring is comprised of a plurality of cutter blade sections connected to each other to form a cutter blade ring, and a part of the outer circumferential edge of one of the cutter blade sections is cut in the circumferential direction of the cutter blade ring and bent upward to form the cutter blade and a part of the inner circumferential edge of the next cutter blade section is cut in the circumferential direction of the cutter blade ring and bent upward to form the cutter blade. In other words, the cutter blade sections of the cutter blade ring are alternately cut along the inner and outer circumferential edges, so that the cutter blade ring has the outer circumferential cutter blades and inner circumferential cutter blades that are alternately displaced.

DETAILED DESCRIPTION OF THE INVENTION

Figure 1:
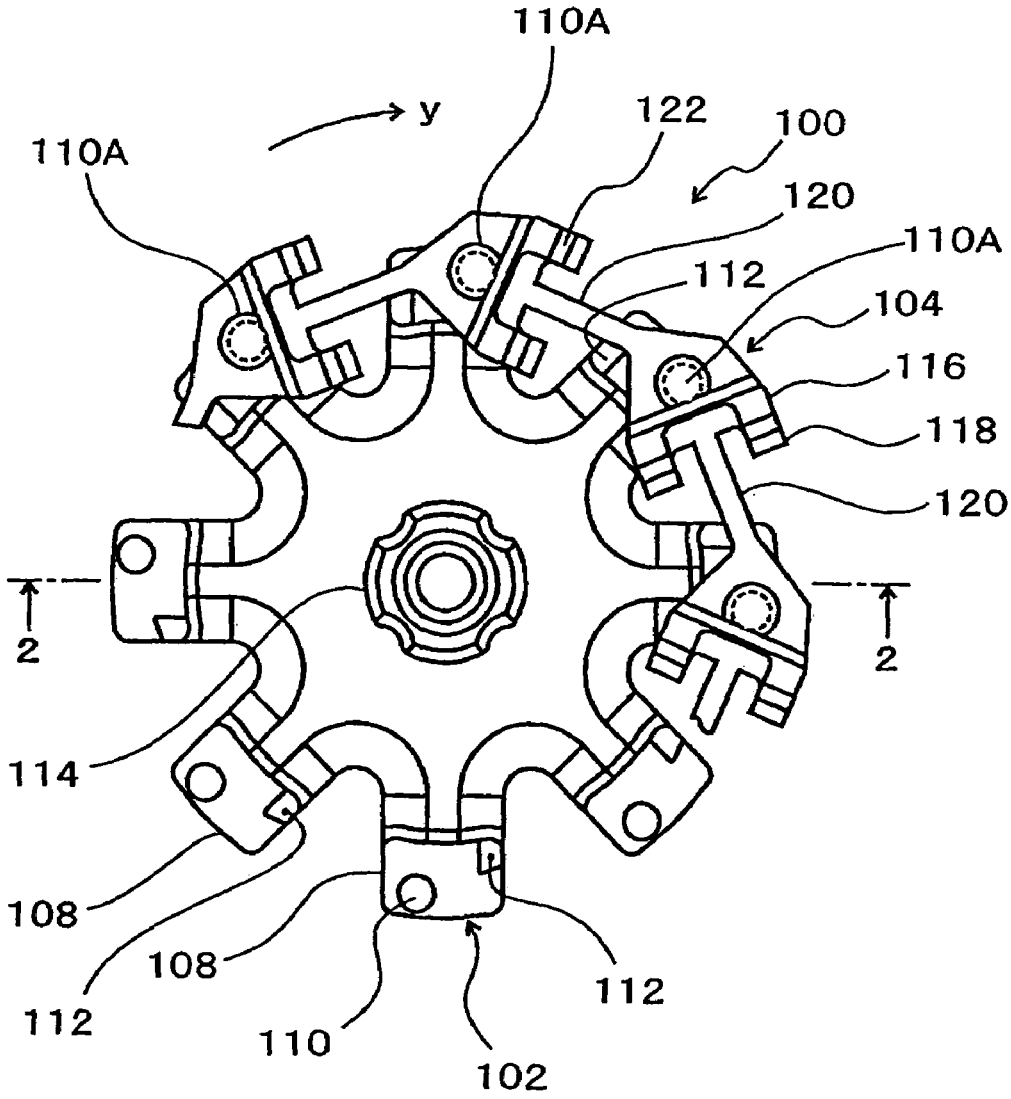
FIG. 1 is a partially cat-away top view of the inner cutter according to one embodiment of the present invention.
Figure 2:
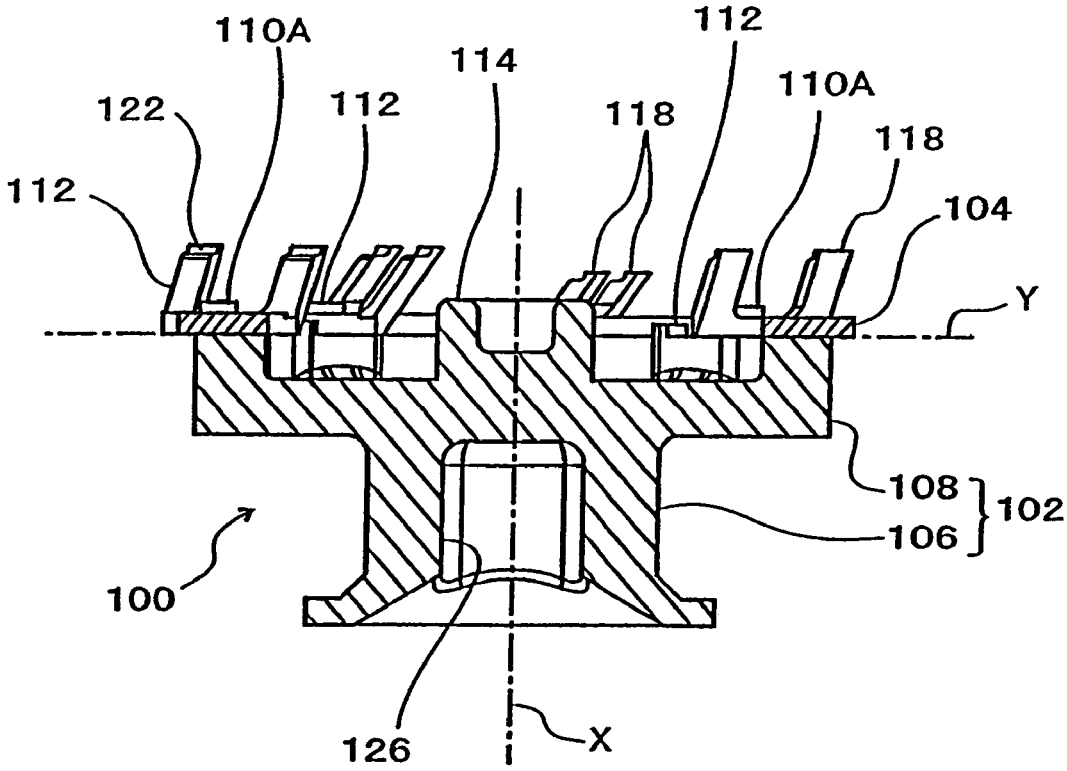
FIG. 2 is a sectional view taken along the line 2—2 in FIG. 1.
Figure 3:
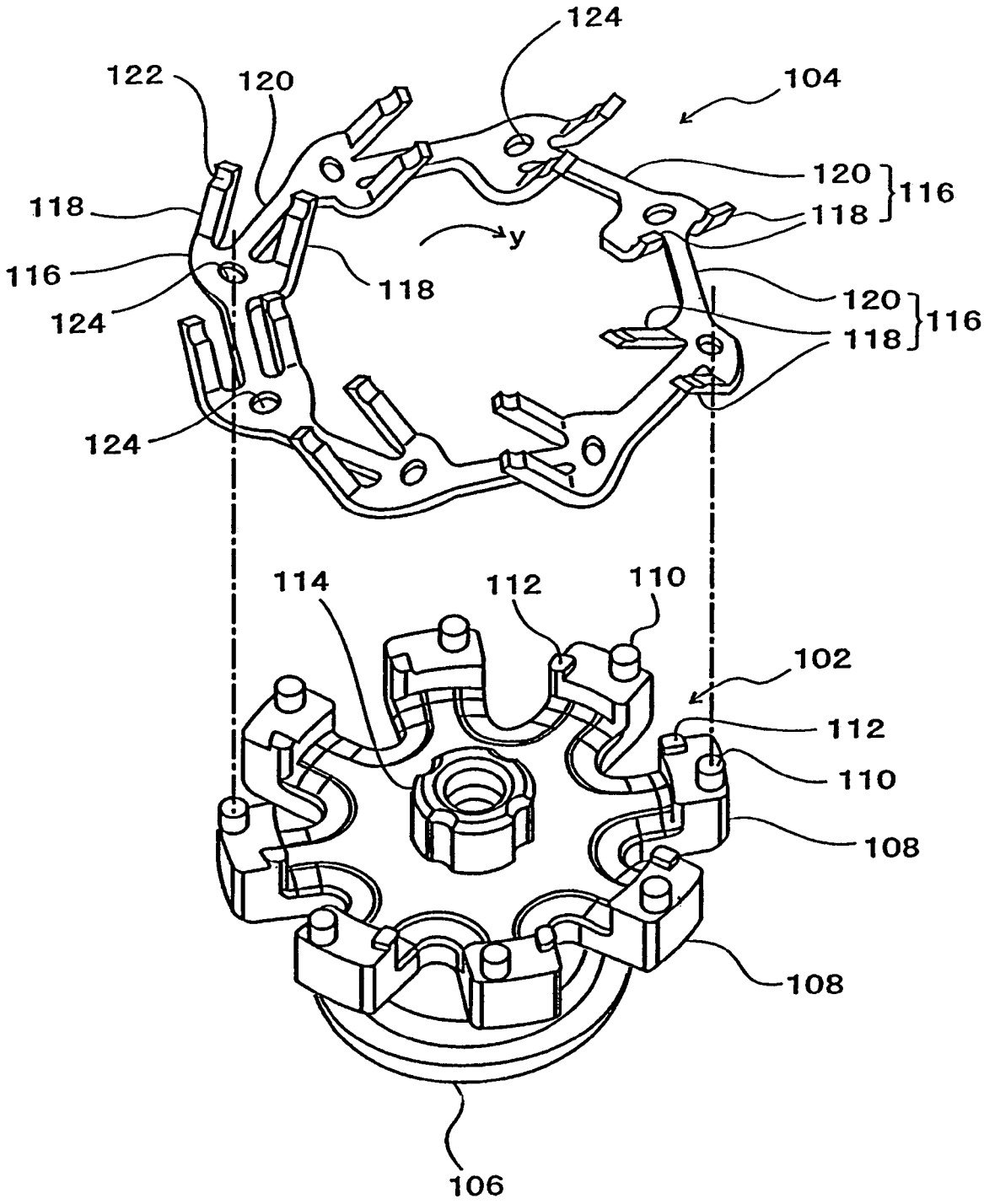
FIG. 3 is an exploded perspective view of the inner cutter of FIG. 1.

In FIGS. 1, 2 and 3, the reference numeral 100 denotes the inner cutter according to one embodiment of the present invention, and this inner cutter 100 comprises an inner cutter base 102 and a cutter blade ring 104 that are joined to form an integral unit.

The inner cutter base 102 is comprised of a boss 106 and eight cutter blade supports 108. The cutter blade supports 108 are in the shape of a plurality of arms that extend radially outward from the boss 106. The boss 106 and the arm-shaped cutter blade supports 108 are integrally molded from a synthetic resin. A POM (polyoxymethylene) resin is an ideal material for the synthetic resin that is used for the boss and cutter blade supports. The tip ends of all of the arms or cutter blade supports 108 are bent upward, and the upper surfaces of the cutter blade supports 108 are on an imaginary plane Y that is perpendicular to the rotational axis X (FIG. 2) of the inner cutter 100.

Projections 110 and 112 protrude from the upper surface of each one of the cutter blade supports 108. The projections 110 secure the cutter blade ring 104 on the cutter blade supports 108 by hot-crimping, and the projections 112 are used for positioning the cutter blade ring 104.

A columnar center projection 114 protrudes from the center of the upper surface of the inner cutter base 102. The center projection 114 engages with a recessed portion (not shown in the drawings) formed in the center of the inner surface of the outer cutter (such as one shown in FIG. 9) when the inner cutter 100 is set in the outer cutter and thus prevents eccentricity of the inner cutter 100 with respect to the outer cutter. In other words, the center projection 114 prevents rotational wobbling of the inner cutter 100.

Figure 14:
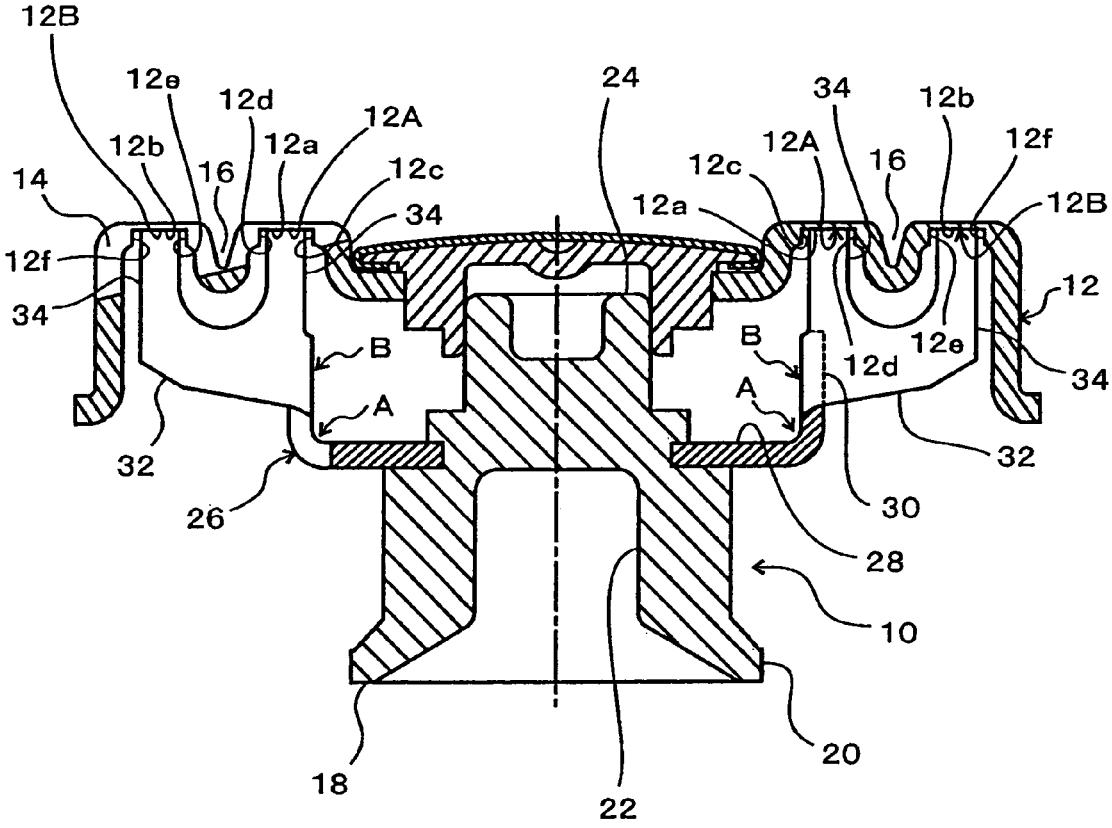
FIG. 14 PRIOR ART
FIG. 14 is a cross sectional side view of the assembled inner and outer cutters of prior art.

As best seen from FIG. 3, the cutter blade ring 104 is comprised of substantially Y-shaped cutter blade sections 116 connected in a ring shape; and each one of the substantially Y-shaped cutter blade sections 116 is comprised of a connecting portion 120 and a pair of cutter blades 118 that are to be positioned in two concentric circular sections (see, for instance, FIG. 14) of the outer cutter. The two cutter blades 118 in a bifurcated shape or letter Y-shape are tilted forward in the direction of rotation y of the inner cutter 100, and a recess 122 is formed in the surface of each cutter blade 118 so that it faces the direction opposite from the direction of rotation y. The Y-shaped cutter blade sections 116 are connected to each other by the connecting portions so that the connecting portions extend between the bifurcated cutter blades 118, thus forming the ring shape.

This cutter blade ring 104 is formed by press-die-stamping a metal plate into a substantially ring-form shape and subsequent or simultaneous bending of the portions constituting the cutter blades 118. Furthermore, the recesses 122 are formed in the cutter blades 118 and cutter blade fastening holes 124 are formed in the cutter blades 116; and this working for the recess and fastening holes is performed at the same time as the press die stamping, and it can be dome in a separate process.

Due to the structure described above, the cutter blade ring 104 is obtained with a small number of press-working. Furthermore, since the cutter blades 118 are bent (raised) upward by small angles as can be seen from FIG. 3, the stress applied to the metal material for the cutter blade ring 114 is small, and the characteristics of the metal material (especially the press-working characteristics) are low. In the present invention, furthermore, as will be described below, since the cutter blade sections 116 are directly fastened to the cutter blade supports 108, vibration of the cutter blade sections 116 is suppressed. Accordingly, thin metal plate can be used for the cutter blade ring 114, and the press-working characteristics are high in this regard as well.

The cutter blade ring 104 described above is fastened to the cutter blade supports 108 of the inner cutter base 102 by hot-crimping. More specifically, the cutter blade ring 104 of the shown embodiment has a total of eight inner cutter fastening holes 124 formed at positions that correspond to the projections 110 of the arms or cutter blade supports 108, and these projections 110 are passed through the inner cutter fastening holes 124 of the cutter blade ring 104, and the upper ends (protruding ends) of the projections 10 are crimped (hot-crimped) by compressing these upper ends while applying heat thereto. In FIGS. 1 and 2, the reference numeral 110A indicates the hot-crimped portions. The other projections 112 on the cutter blade supports 108 are used for positioning the cutter blade ring 104 by being contacted the side edges of the connecting portions 120 as shown in FIG. 1.

After the cutter blade ring 104 has thus been fastened in place, the tip ends of all of the cutter blades 118 are ground to form cutting edges. Of course, the cutter blade ring 104 is heat-treated at an appropriate time following the press-working.

The boss 106 of the inner cutter base 102 of the inner cutter 100 is formed with an engaging hole 126 (see FIG. 2) that is to be engaged with a corresponding rotary shaft (not shown in the drawings) of the shaver; and after being covered by the outer cutter (see FIG. 9), the inner cutter is rotationally driven in use of the shaver.

In the above embodiment, the cutter blade supports 108 extend radially or they are spacedly provided in the circumferential direction of the inner cutter 100; and when the cutter blade ring 104 is provided on the inner cutter base 106, a pair of cutter blades 118 are located between two adjacent cutter blade supports 108. Accordingly, the shaving debris made by the cutter blades 118 smoothly fall down through the gaps between the cutter blade supports 118, so that shaving debris tends not to adhere to the cutter blades 118, and cleaning is facilitated.

Figure 4:
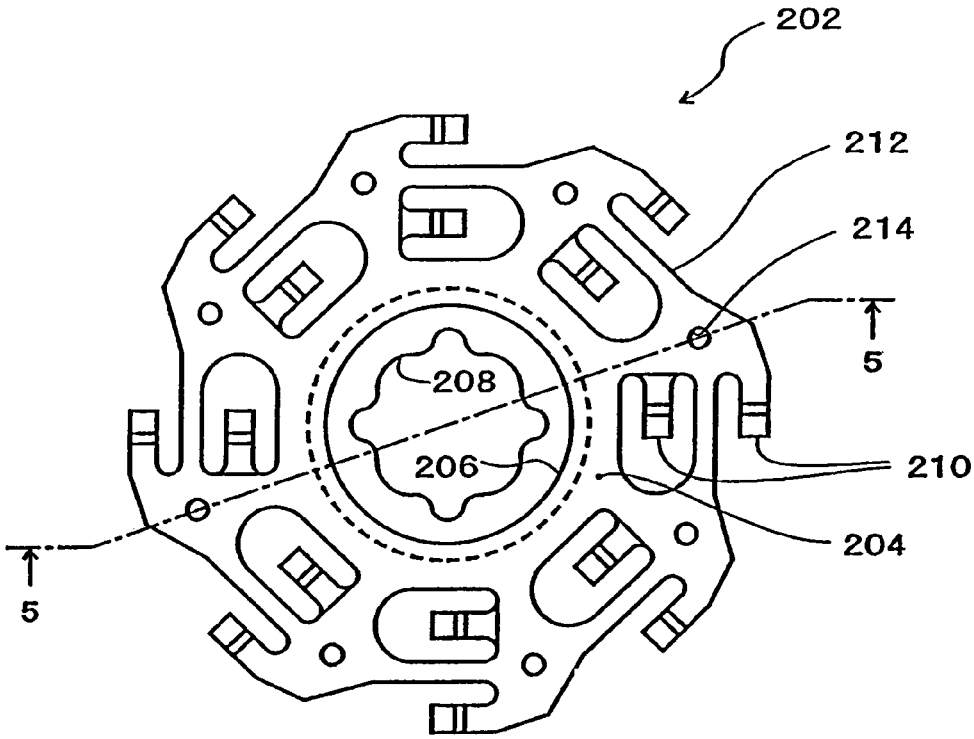
FIG. 4 is a top view of the cutter blade ring according to another embodiment of the present invention.
Figure 5:
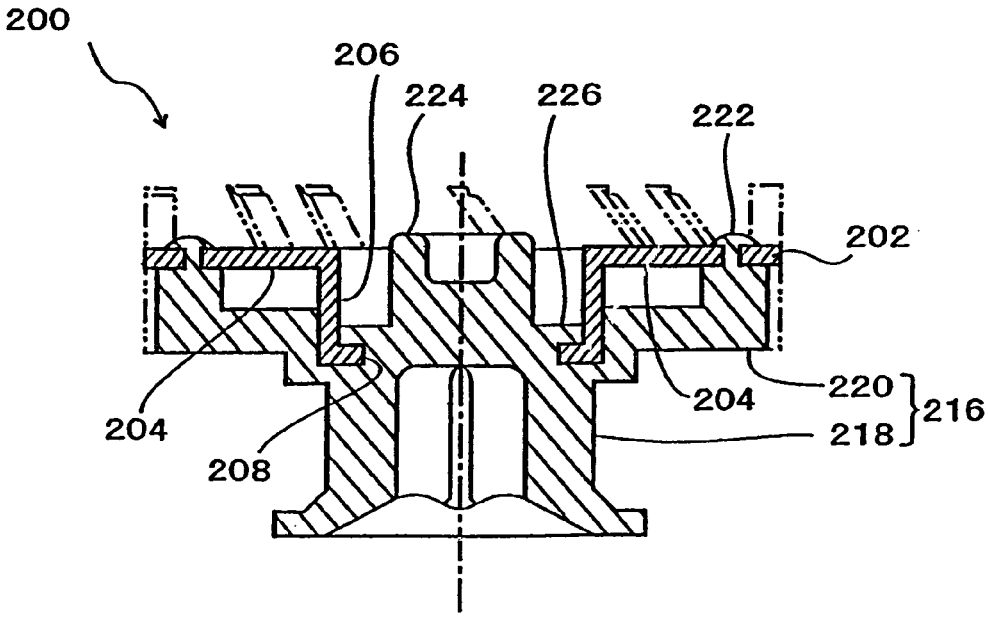
FIG. 5 is a sectional side view of the overall inner cutter taken along the line 5—5 in FIG. 4.

FIGS. 4 and 5 show another embodiment of the present invention

As shown in FIG. 4, in the cutter blade ring 202 of this embodiment, the portions that correspond to the cutter blade sections 116 in FIGS. 1 and 3 are connected and integrated by a flange portion 204 located on the inner side of the ring 202.

A small-diameter portion 206 which is formed into a substantially cup-form shape by deep-drawing is formed in the center of the flange portion 204, and an opening 208 is formed in the bottom of this small-diameter portion 206. In the edge of this opening 208, as seen from FIG. 4, two different circular arcs are alternately formed at equal intervals, with four of each of these two types of circular arcs being formed. Cutter blades 210, connecting portions 212 and cutter blade fastening holes 214 are formed in the cutter blade ring 202 in the same manner as those in the cutter blade ring 104 shown in FIGS. 1 and 3.

As shown in FIG. 5, the inner cutter base 216 has cutter blade supports 220 and projections 222. The cutter blade supports 220 radially extend from the boss 218, and the projections 222 protrude from the upper surfaces of the tip ends of the cutter blade supports 220. The cutter blade ring 202 is carried on the cutter blade supports 220 with the cutter blade fastening holes 214 aligned with the projections 222. The tip ends of the projections 222 that protrude from the cutter blade fastening holes 214 are hot-crimped so that they hold the cutter blade ring 202. FIG. 5 shows the state after the hot-crimping of the projections 222 is done. A columnar center projection 224 of the boss 218 is passed through the central opening 208 of the cutter blade ring 202, and the inner circumferential rim of the opening 208 is fastened to the projection 224 by hot-crimping. The reference numeral 226 in FIG. 5 indicates the hot-crimped portion.

In the structure shown in FIGS. 4 and 5, when the cutter blade ring 202 is mounted on the inner cutter base 216, the portion of the cutter blade ring 202 located near the outer circumference is supported from beneath by the cutter blade supports 220, and the portion located near the inner circumference is fastened to the vicinity of the boss 218. Accordingly, the connection of the cutter blade ring 202 and the inner cutter base 216 is greatly strengthened, and the anti-vibration effect of the cutter blade ring 202 is high.

Figure 6:
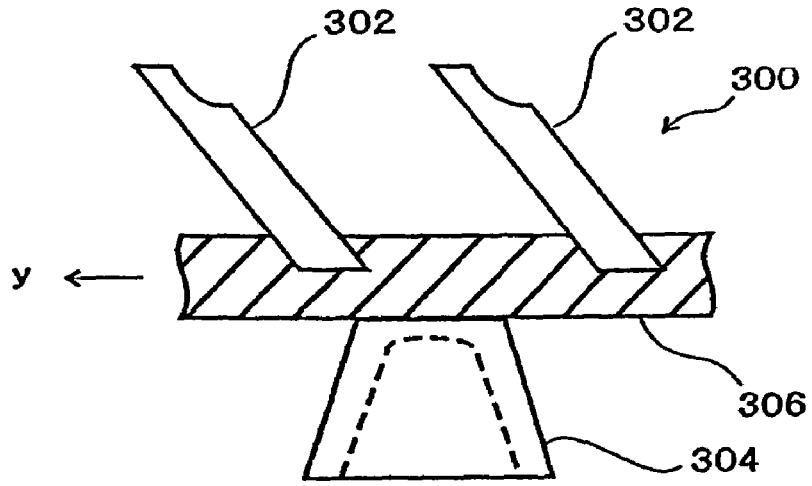
FIG. 6 is a partially sectional side view of the inner cutter of still another embodiment of the present invention.

FIG. 6 shows, in cross-section, still another structure of the inner cutter of the present invention.

In this structure, the cutter blades 302 of the inner cutter 300 are in an individual form and do not formed into a cutter blade ring, and the individual cutter blades 302 are inserted in a circular cutter blade support 306 provided on the inner cutter base 304. More specifically, all of the cutter blades 302 are fixed in place in the mold prior to the resin-molding of the inner cutter base 304, and the inner cutter base 304 is injection-molded in this state (insert-molding).

Figure 7:
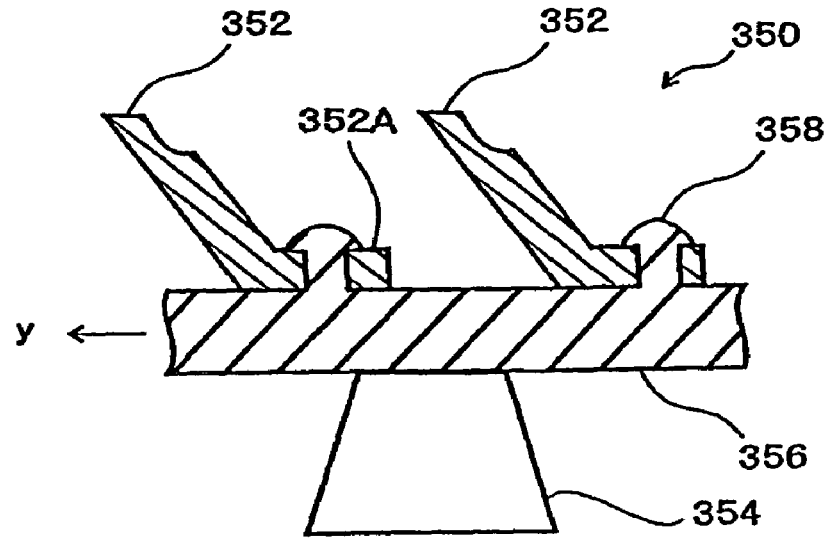
FIG. 7 is a partially sectional side view of the inner cutter of still another embodiment of the present invention.

FIG. 7 shows, in cross-section, still another structure of the inner cutter of the present invention.

In the structure of FIG. 7, each one of the cutter blades 352 of the inner cutter 350 are fastened by way of hot-crimping to the cutter blade support 356 of the inner cutter base 354. More specifically, the lower portions 352A of the cutter blades 352 are bent so that the lower portions 352A take a horizontal configuration and come into contact with the upper surface of the cutter blade support 356, and projections 358 formed on the upper surface of the cutter blade support 356 pass through holes formed in the lower horizontal portions 352A of these cutter blades 352, and the protruding ends of the projections 358 are hot-crimped. FIG. 7 shows the state after the hot-crimping of the projections 358 is completed.

When individual cutter blade sections 302 and 352 are provided on the inner cutter base as shown in FIGS. 6 and 7, a plurality of cutter blade sections 302 or 352 can be combined to form several groups. When the cutter blade sections form groups, the inner cutter is formed with arms (or the cutter blade supports) in the same number as the number of the groups, so that each group of cutter blade sections is provided on each arm (cutter blade support). In this structure, the top surface area of the arms differ from each other so as to match the size of the combined cutter blade sections.

Figure 8A:
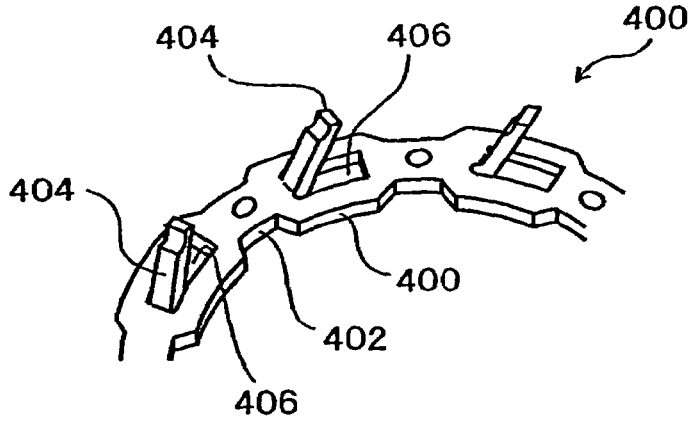
FIGS. 8(*a*) and 8(*b*) are respectively perspective views of a part of the inner cutter of still another embodiment of the present invention.
Figure 8B:
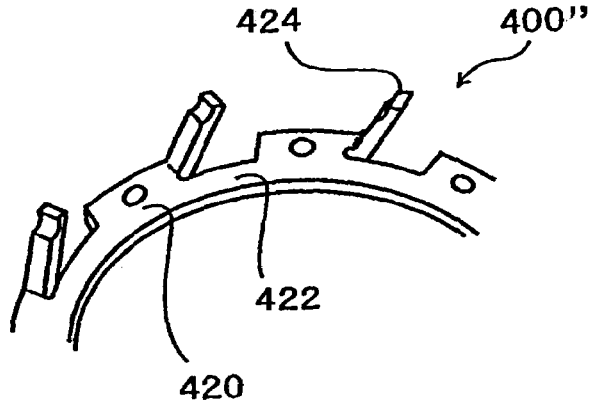

FIGS. 8(*a*) and 8(*b*) respectively show a part of the cutter blade rings according to the embodiment of the present invention. Each of these cutter blade rings is for an inner cutter that is used in a shaver that includes an outer cutter formed inside thereof with a single annular section (or a single annular track, not shown).

In the structure of FIG. 8(*a*), the cutter blade ring 400' has a configuration in which a plurality of cutter blade sections 400 are connected to each other in a ring shape at the connecting portions 402 to form a cutter blade ring 400'; and in each cutter blade section 400, a cutter blade 404 is formed by being cut in the circumferential direction of the cutter blade ring 400' and bent upward at substantially the center of the cutter blade section 400, leaving an opening 406 that remains after cutting of the cutter blade 404. Since each cutter blade section 400 surrounds the opening 406, the cutter blade ring 400' has an increased rigidity.

In the structure of FIG. 8(*b*), a plurality of cutter blade sections 420 are connected to each other in a ring shape at the connecting portions 422 to form a cutter blade ring 400"; and in each cutter blade section 420, a cutter blade 424 is cut in the circumferential direction of the cutter blade ring 400" and bent upward along the outer circumferential edge in a somewhat cantilever configuration. This cutter blade ring 400" is narrow in width, and thus it is small in size and light in weight.

Figure 9:
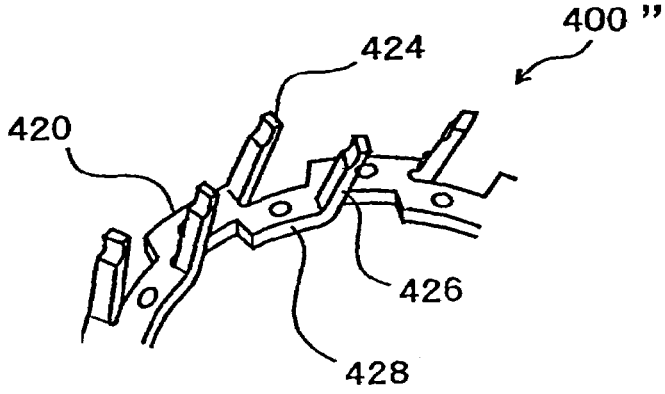
FIG. 9 is a perspective view of a part of the inner cutter of still another embodiment of the present invention.
Figure 10:
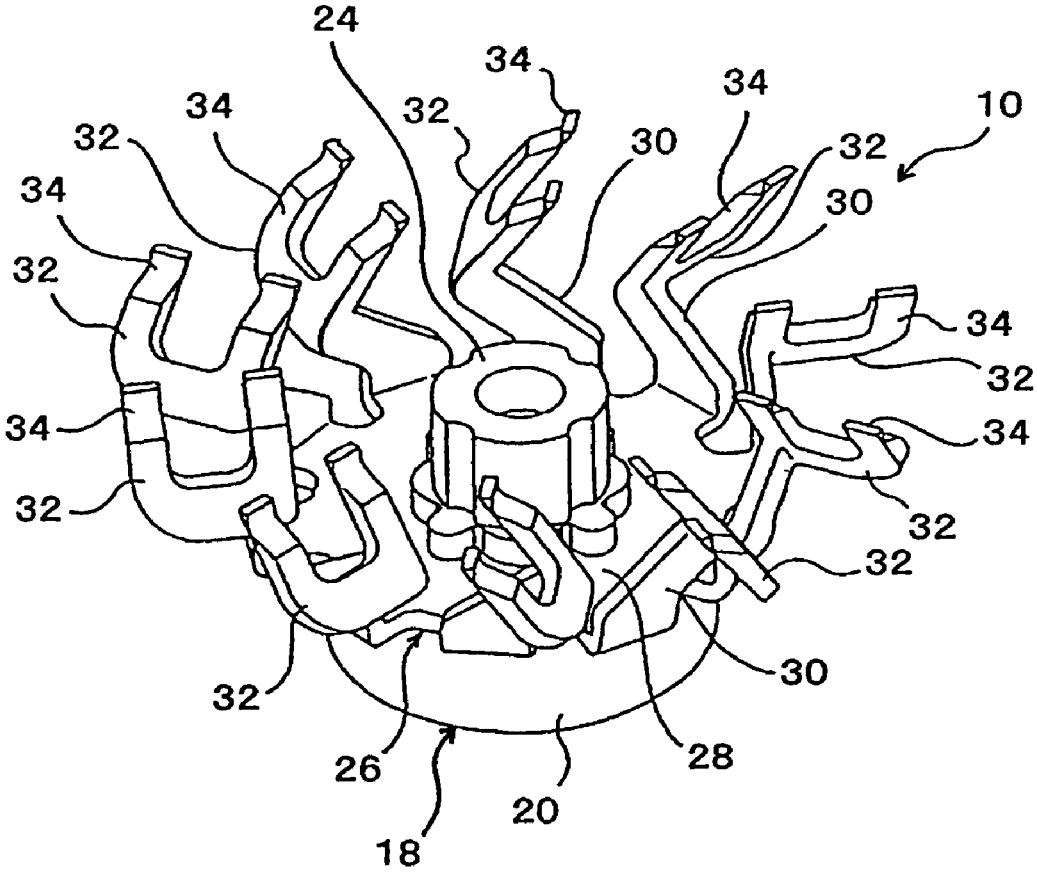
FIG. 10 PRIOR ART
FIG. 10 is a perspective of a conventional inner cutter.
Figure 11:
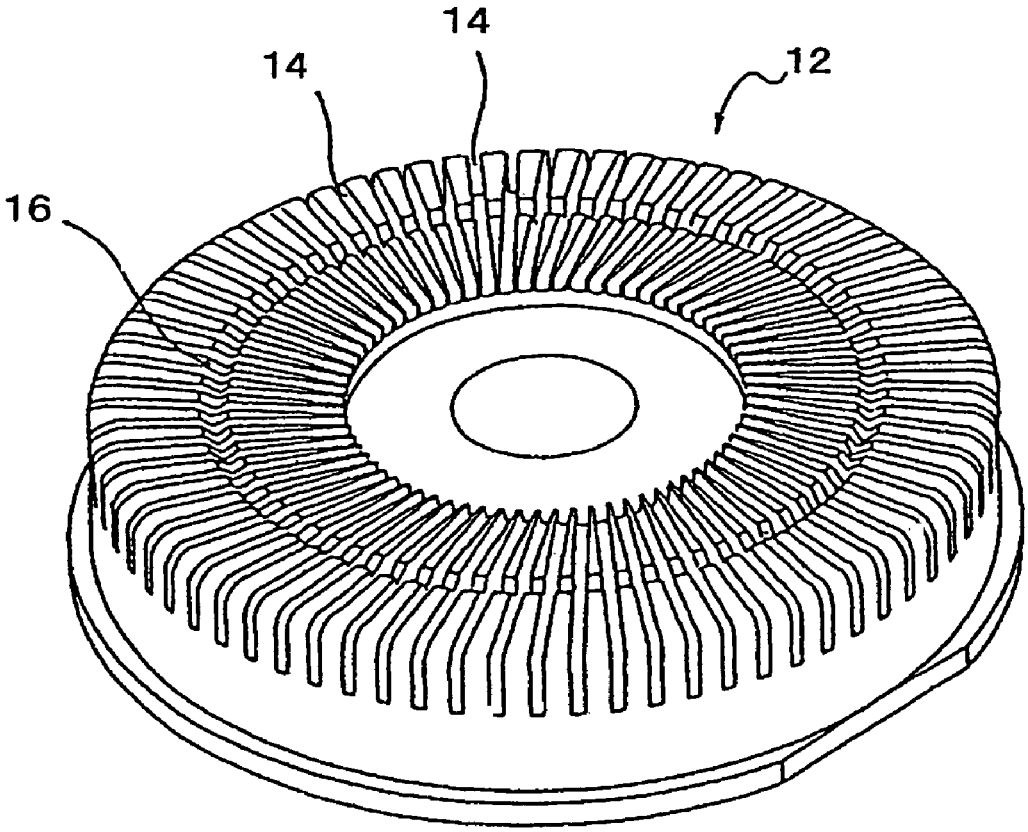
FIG. 11 PRIOR ART
FIG. 11 is a perspective view of a conventional outer cutter.
Figure 12:
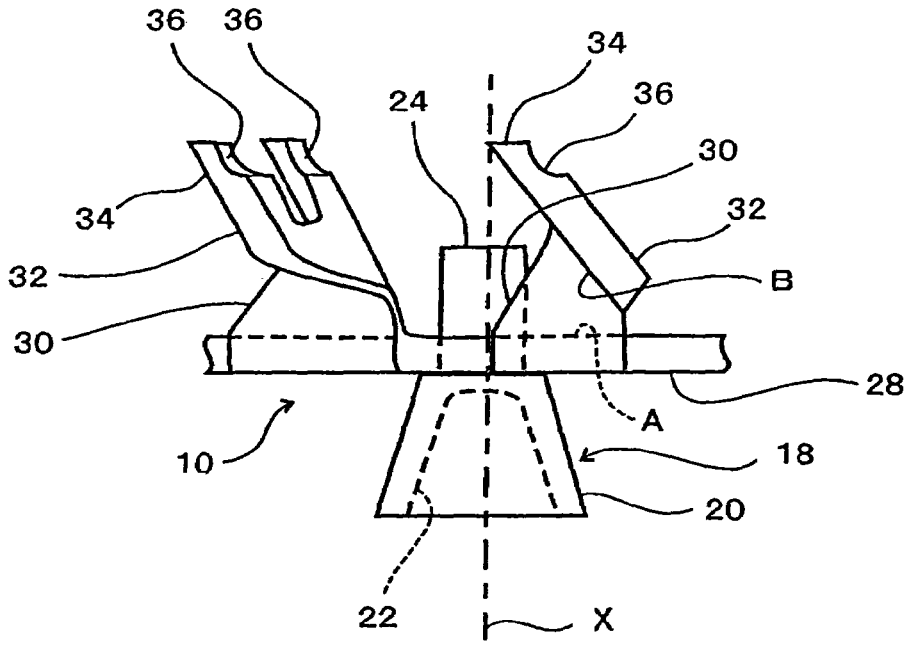
FIG. 12 PRIOR ART
FIG. 12 is a side view of a part of the conventional inner cutter.
Figure 13:
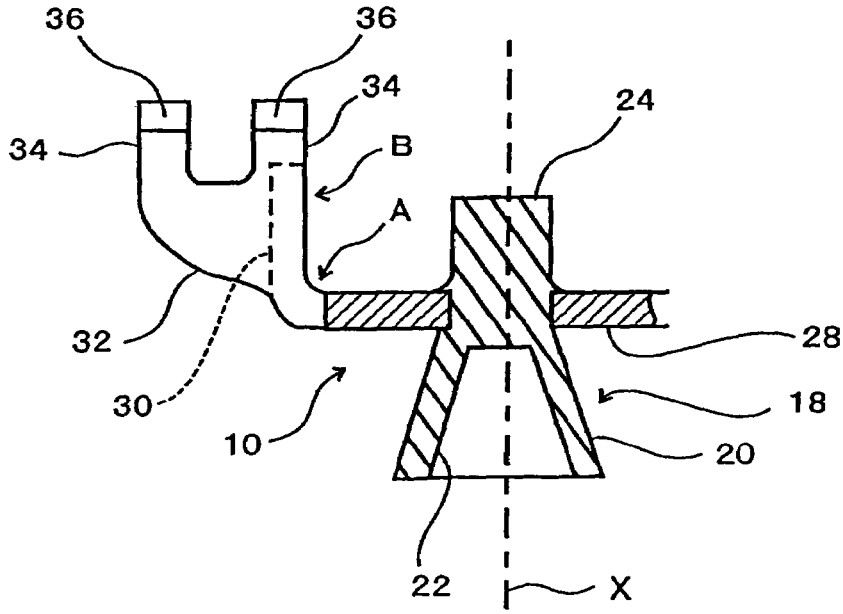
FIG. 13 PRIOR ART
FIG. 13 is a partially cross-sectional side view of a part of the conventional inner cutter.

FIG. 9 shows a part of the cutter blade ring according to still another embodiment of the present invention. The cutter blade ring 400'" of FIG. 9 is for an inner cutter used in a shaver that includes an outer cutter formed inside thereof with double concentric annular sections (or double concentric annular tracks, not shown).

This cutter blade ring 400'" has a configuration in which a cutter blade 426 is further formed in the cutter blade section 420 of the cutter blade ring shown in FIG. 8(*b*). In other words, in this cutter blade ring 400'", a cutter blade 424 is formed by being cut in the circumferential direction of the cutter blade ring 400'" and bent upward along the outer circumferential edge of a cutter blade section 420 of a ring shaped metal plate, and another cutter blade 426 is formed by being cut and bent upward along the inner circumferential edge of a cutter blade section 428 which is next to the cutter blade section 420 of the ring shaped metal plate, so that the outer circumferential cutter blades 424 and the inner circumferential cutter blades 426 are alternately displaced circumferentially and radially. In this structure, one cutter blade section (for instance, the cutter blade section 428) for one cutter blade is a connecting portion for the next cutter blade section (for instance, the cutter blade section 420), and such one cutter blade section (for instance, the cutter blade section 420) for one cutter blade is a connecting portion for the next cutter blade section (for instance, the cutter blade section 428). In use, the cutter blades 426 on the inner circumferential edge of the cutter blade ring 400'" come into contact and slide along the inner surface of the inside annular section (track) of a two-track outer cutter, and the cutter blades 424 on the outer circumferential edge come into contact with and slide along the inner surface of the outside annular section (track) of such a two-track outer cutter.

The invention claimed is:

1. An electric rotary shaver comprising a substantially circular disk forming an outer cutter, which has hair entry openings in a top surface thereof, and an inner cutter, which rotates while making sliding contact with an inner surface of said outer cutter, wherein said outer cutter is formed inside thereof with at least one concentric annuls track; and said inner cutter is comprised of:

an inner cutter base comprising a boss that engages with a rotary shaft of said shaver and a cutter blade support that extends outward from said boss, said boss and said cutter blade support being coupled together to be integrally formed, and a plurality of cutter blade sections which are formed with a cutter blade that makes sliding contact with said at least two concentric annular tracks and which are provided on said cutter blade support; and wherein said cutter blade sections have cutter blades that are disposed side by side in a radial direction of said inner cutter and make a sliding contact with said annular tracks, said cutter blade sections being connected to each other to form at least one cutter blade ring; and each of said cutter blade sections is in a letter Y-shape and said cutter blades are formed in bifurcated portions of said Y-spaced cutter blade section, said cutter blade sections being connected to each other at connecting portions thereof to form said cutter blade ring.

2. The electric rotary shaver according to claim 1, wherein said cutter blade support is in a shape of a plurality of arms that extend radially from said boss.

3. The electric rotary shaver according to claim 1, wherein said outer cutter is formed inside thereof with a single annular track.

4. The electric rotary shaver according to claim 1 wherein said plurality of cutter blade sections each having said cutter blade form a plurality of groups and said groups of cutter blade sections are provided on said cutter blade support.

5. The electric rotary shaver according to claim 1 wherein said at least one cutter blade ring is provided on said cutter blade support by hot-crimping.

6. The electric rotary shaver according to claim 1 wherein said cutter blade sections axe insert-molded on said inner cutter base.

7. The electric rotary shaver according to claim 1, wherein said openings are slits that cross said annular tracks in a radial direction of said outer cutter.

8. An electric rotary shaver comprising a substantially circular disk forming an outer cutter, which has hair entry openings in a top surface thereof, and an inner cutter, which rotates while making sliding contact with an inner surface of said outer cutter, wherein said outer cutter is formed inside thereof with at least two annular track; and said inner cutter is comprised of:

an inner cutter base comprising a boss that engages with a rotary shall of said shaver and a cutter blade support that extends outward from said boss, said boss and said cutter blade support being coupled together to be integrally formed, and a plurality of cutter blade sections which are formed with cutter blades that make sliding contact with said at least two annular tracks and which are provided on said cutter blade support; and wherein said cutter blades are disposed side by side in a radial direction of said inner cutter, said cutter blade sections are connected to each other to form at least one cutter blade ring;

portions of a circumferential edge of said at least one cutter blade ring are cut in a circumferential direction of said at least one cutter blade ring and bent up to form said cutter blades; and said cutter blade ring is held at an inner circumferential edge thereof on said boss.

9. An electric rotary shaver comprising a substantially circular disk forming an outer cutter, which has hair entry openings in a top surface thereof, and an inner cutter, which rotates while making sliding contact with an inner surface of said outer cutter, wherein said outer cutter is formed inside thereof with at least one annular track; and said inner cutter is comprised of:

an inner cutter base comprising a boss that engages with a rotary shaft of said shaver and a cutter blade support that extends outward from said boss, said boss and said cutter blade support being coupled together to be integrally formed, and a plurality of cutter blade sections which are formed with a cutter blade that makes a sliding contact with said at lease one annular track and which are provided on said cutter blade support; and wherein said plurality of cutter blade sections are connected to form a cutter blade ring, said cutter blade ring is provided on said cutter blade support, and a part of a central portion of each one of said cutter blade sections of said cutter blade ring is cut in a circumferential direction of said cutter blade ring and bent upward to form said cutter blade.

10. An electric rotary shaver comprising a substantially circular disk forming an outer cutter, which has hair entry openings in a top surface thereof, and an inner cutter, which rotates while making sliding contact with an inner surface of said outer cutter, wherein said outer cutter is formed inside thereof with at least one annular track; and said inner cutter is comprised of:

an inner cutter base comprising a boss that engages with a rotary shaft of said shaver and a cutter blade support that extends outward from said boss, said boss and said cutter blade support being coupled together to be integrally formed, and a plurality of cutter blade sections which are formed with a cutter blade that makes a sliding contact with said at least one annular track and which are provided on said cutter blade support; and wherein said plurality of cutter blade sections are connected to form a cutter blade ring, said cutter blade ring is provided on said cutter blade support, and a part of a outer circumferential edge of each one of said cutter blade sections of said cutter blade ring is cut in a circumferential direction of said cutter blade ring and bent upward to form said cutter blade.

11. An electric rotary shaver comprising a substantially circular disk forming an outer cutter, which has hair entry openings in a top surface thereof, and an inner cutter, which rotates while making sliding contact with an inner surface of said outer cutter, wherein said outer cutter is formed inside thereof with a plurality of annular tracks, and said inner cutter is comprised of:

an inner cutter base comprising a boss that engages wit a rotary shaft of said shaver and a cutter blade support that extends outward from said boss, said boss and said cutter blade support being coupled together to be integrally formed, and a plurality of cutter blade sections which are formed with a cutter blade that makes a sliding contact with said plurality of annular tracks and which are provided on said cutter blade support; and said plurality of cutter blade sections are connected to each other to form a cutter blade ring, and a part of an outer circumferential edge of one of said cutter blade sections is cut in a circumferential direction of said cutter blade ring and bent upward to form said cutter blade and a part of an inner circumferential edge of another one of said cutter blade sections which is next to said one cutter blade section is cut in a circumferential direction of said cutter blade ring and bent upward to form said cutter blade.

12. An electric rotary shaver comprising a circular form outer cutter, which has hair entry openings in a top surface thereof, and an inner cutter, which rotates while making sliding contact with a inner surface of said outer cutter, wherein:

said outer cutter is formed inside thereof with at least two annular tracks; and said inner cutter is comprised of;

a boss that engages with a rotary shaft of said shaver and an inner cutter blade support that is coupled to and extent outwardly from said boss; and an inner cutter blade ring which is formed with cutter blades that make sliding contact with said at least two annular tracks and which is provided on said inner cutter blade support, said inner cutter blade ring comprising a ring shaped metal plate wherein said cutter blades are formed by alternately cutting portions of said ring shaped metal plate on at least one of inner and outer peripheries to form blade portions and bending said blade portions upward to form said cutter blades.

13. The electric rotary shaver according to claim 12, wherein said inner cutter blade ring is coupled to said inner cutter blade support by crimping projections from said inner cutter blade support extending through holes in said inner cutter blade ring.

14. The electric rotary shaver according to claim 13 wherein at least said boss is made from synthetic resin.

15. The electric rotary shaver according to claim 13 wherein said boss, said inner cutter blade support and said projections from said inner cutter blade support are made from synthetic resin.

16. The electric rotary shaver comprising a circular form outer cutter, which has hair entry openings in a top surface thereof, and an inner cutter, which rotates while making sliding contact with an inner surface of said outer cutter, wherein:

said outer cutter is formed inside thereof with at least one annular track; and said inner cutter is comprised of:

a boss that engages with a rotary shaft of said shaver and an inner cutter blade support that is coupled to ad extends outwardly from said boss; and an inner cutter blade ring which is formed with cutter blades that make sliding contact with said annular track and which is provided on said inner cutter blade support, said inner cutter blade ring comprising a ring shaped metal plate wherein said cutter blades are formed by cutting portions of said ring shaped metal plate on at least an outer periphery thereof to form blade portions and bending said blade portions upwardly to form said cuter blades.

17. The electric rotary shaver according to claim 16 wherein said blade portions are formed by press-dye-stamping said ring shaped metal plate.

18. The electric rotary shaver according to claim 17 wherein said ring shaped metal plate is further provided with a inner substantially cup-form portion which is coupled to said inner cutter blade support adjacent said boss.

* * * * *